US007581562B2

(12) United States Patent
Steinhilber et al.

(10) Patent No.: US 7,581,562 B2
(45) Date of Patent: Sep. 1, 2009

(54) HYDRAULIC DISTRIBUTOR WITH TORQUE SLITS

(75) Inventors: Armin Steinhilber, Chaponnay (FR); Michel Rivolier, l'Arbresle (FR)

(73) Assignee: Bosch Rexroth D.S.I., Venissieux (FR)

( * ) Notice: Subject to any disclaimer, the term of this patent is extended or adjusted under 35 U.S.C. 154(b) by 832 days.

(21) Appl. No.: 10/560,583

(22) PCT Filed: Jun. 28, 2004

(86) PCT No.: PCT/FR2004/001644

§ 371 (c)(1),
(2), (4) Date: Jan. 17, 2006

(87) PCT Pub. No.: WO2005/017364

PCT Pub. Date: Feb. 24, 2005

(65) Prior Publication Data

US 2006/0137751 A1 Jun. 29, 2006

(30) Foreign Application Priority Data

Jul. 16, 2003 (FR) ..... 03 08685

(51) Int. Cl.
*F15B 13/04* (2006.01)

(52) U.S. Cl. ..... 137/625.68; 91/446

(58) Field of Classification Search ..... 137/625.68, 137/625.69; 91/445, 446
See application file for complete search history.

(56) References Cited

U.S. PATENT DOCUMENTS 2,359,802 A * 10/1944 Stephens ..... 137/625.68
2,448,532 A * 9/1948 Kirkham ..... 137/625.68
2,651,324 A * 9/1953 Hodgson et al. ..... 137/625.68
2,946,347 A 7/1960 Ruhl
2,965,133 A * 12/1960 Rice et al. ..... 137/625.68
3,004,555 A * 10/1961 Haberland ..... 137/625.68
3,215,160 A * 11/1965 Rice ..... 137/625.68
3,255,777 A 6/1966 Rice et al.
3,481,364 A * 12/1969 Hodgson et al. ..... 137/625.68
3,482,600 A * 12/1969 Hodgson ..... 137/625.68
3,616,817 A * 11/1971 Pignolet, L. ..... 137/625.68
3,707,988 A 1/1973 Hodgson
3,774,635 A * 11/1973 Farrell et al. ..... 137/625.68
3,986,522 A * 10/1976 Janvrin ..... 137/625.68
4,428,400 A * 1/1984 Tantardini ..... 137/625.68
4,548,239 A * 10/1985 Eskildsen ..... 137/625.68
4,789,002 A * 12/1988 Williams ..... 137/625.69

(Continued)

FOREIGN PATENT DOCUMENTS

GB 1 516 224 A 6/1978

*Primary Examiner*—John Rivell
(74) *Attorney, Agent, or Firm*—Oliff & Berridge, PLC

(57) ABSTRACT

The invention relates to a hydraulic distributor comprising a casing, a pressurized fluid inlet, a fluid return port, at least two working ports, a slide which is housed in the casing, a passage which is provided in the casing in order to connect the inlet with the working ports, adjustment means which are connected to a load detection line channel, a supply bridge which opens into the slide hole on either side of the inlet chamber, and two main check valves which are borne internally by the slide, The inventive distributor further comprises two secondary check valves which are mounted in the longitudinal channels upstream of the main check valve heads and which are connected to torque slits which open into the hole in which the slide moves.

5 Claims, 1 Drawing Sheet

Figure 1:
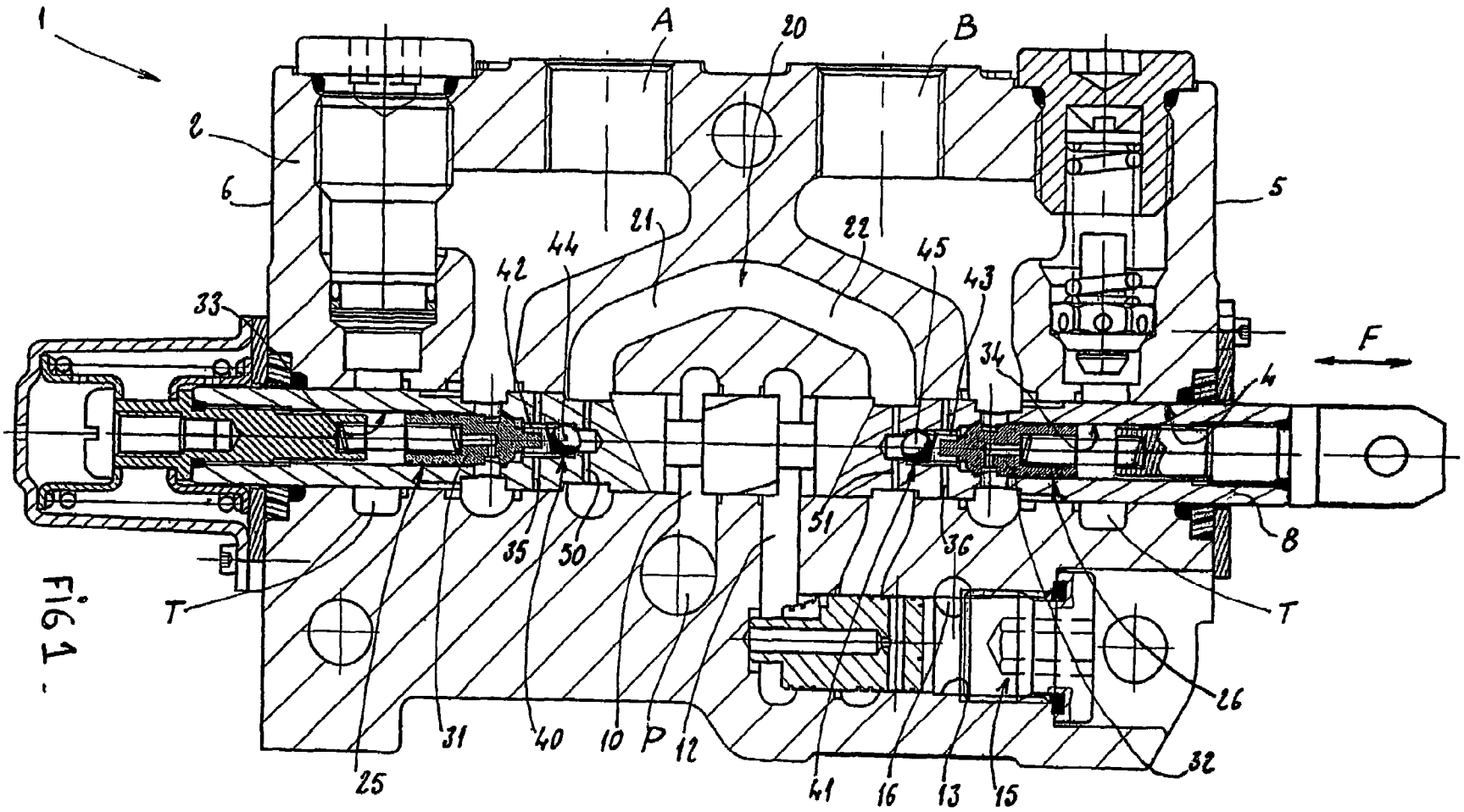

U.S. PATENT DOCUMENTS 5,161,575 A * 11/1992 Morikawa et al. ..... 137/625.68
5,469,888 A * 11/1995 McAlister ..... 137/625.68
6,098,403 A * 8/2000 Wilke ..... 137/625.68
6,539,712 B2 * 4/2003 Konishi et al. ..... 91/445

* cited by examiner

HYDRAULIC DISTRIBUTOR WITH TORQUE SLITS

The present invention relates to hydraulic distributors and in particular to hydraulic distributors in which the flow is split independently of the load.

Hydraulic distributors comprising:

a distributor body, an intake port for pressurized hydraulic fluid which port is intended to be connected to a source of pressurized hydraulic fluid, a return port for returning fluid to a reservoir, at least two working ports each of which is intended to be connected to at least one hydraulic receiver to supply and return the fluid, a slide housed in a bore formed in the body and which is intended to be moved longitudinally to selectively transmit the pressurized hydraulic fluid to the working ports from the intake port, a passage formed in the body for selectively connecting the intake port to the working ports, regulating means which are situated in said passage to be inserted between the intake port and the working ports and which are associated with a load detection line channel, a supply bridge which comprises two branches each opening into the bore of the slide on each side of the intake port in order to be connected to the regulating means and to the fluid return port respectively, and two main nonreturn valves which are borne entirely by the slide, these respectively being inserted between the supply bridge and the working ports and each comprising a valve head able to move in a longitudinal channel itself connected to at least one transverse supply slit which opens into the bore, are known.

Even though such hydraulic distributors are entirely satisfactory as regards the split of the flow rate of hydraulic fluid independently of the pressure of the load and the level of saturation of the hydraulic pump, they do have the disadvantage of causing jerkiness as the receiver or receivers connected to this distributor start to move.

The operator has then to compensate for these movements, using his experience, and this is not a satisfactory solution.

In consequence, it is an object of the present invention to provide a hydraulic distributor that solves the aforementioned disadvantages, that is to say that is able to control a hydraulic receiver without jerkiness on start-up, particularly when the motion supplied needs to be slow.

To this end, according to the present invention, the hydraulic distributor of the aforementioned type is essentially characterized in that it further comprises two secondary nonreturn valves which are respectively mounted in the longitudinal channels upstream of the heads of the main nonreturn valves, and in that the secondary valves are connected to torque slits which open into the bore in which the slide moves, each of these slits being connected, at least in one position of the slide, to one branch of the supply bridge.

Thus, by virtue of these provisions, the flow of the hydraulic fluid when a receiver is operated is far more gradual which means that no jerkiness is felt.

Advantageously, the secondary nonreturn valves are open during the phases of exhausting of the hydraulic fluid into the portion of the slide opposed to the pressure of the load in the working port.

As a preference, the torque slits are of circular cross section.

As an alternative, the torque slits are of oblong cross section.

As yet another alternative, the torque slits are of lens-shaped cross section.

In any event, the invention will be clearly understood with the aid of the description which follows, with reference to the attached diagrammatic drawing which depicts, by way of nonlimiting example, one preferred embodiment of a hydraulic distributor according to the present invention.

The single FIGURE is a view in cross section of the hydraulic distributor according to the present invention.

The hydraulic distributor 1 depicted in the figure comprises a body 2 in which there are formed an intake port P for a pressurized fluid, a return port T for returning the fluid to a reservoir (not depicted), and two working ports A and B each of which is intended to be connected to at least one hydraulic receiver (not depicted).

The intake port P is in the form of a channel passing through the body 1 transversely to the plane of the drawing and opening onto the two main faces of the body which act as bearing faces when several distributors like the one depicted in the figure are stacked together side by side. Likewise, the port T is made up of one or two channels passing through the body 1 transversely to the plane of the drawing.

The distributor 1 also has a bore 4 which passes longitudinally through the body 1, opening onto the two opposite faces 5 and 6 of this body, and in which a slide 8 is mounted.

The slide 8 is able to slide in this bore in a back and forth movement in the directions defined by the double-headed arrow F.

In a conventional way, the body 2 and the slide 8 comprise passages and/or grooves arranged in such a way as to collaborate with a view to connecting or closing off the ports P, T, A and B as desired according to the position occupied by the slide 8.

Furthermore, the body 2 has a supply chamber 10 which is associated with the slide 8 and is in constant communication with the intake port P.

Opening near to this supply chamber 10 is a passage 12 which communicates selectively with the working ports A and B according to the movement of the slide 8 and which has a housing 13 in which regulating means 15, themselves associated with a load detection line channel 16 well known per se, are installed.

Furthermore, a supply bridge 20 is formed in the body 1 and comprises two branches 21 and 22 which open respectively into the bore 4 in which the slide 8 moves. Each of these branches is situated one on each side of the supply chamber 10 and of the passage 12 in order to be selectively connected to the ports P, A and B respectively.

The slide 8 internally possesses two main nonreturn valves 25 and 26 which are arranged in such a way as to be respectively inserted between the supply bridge 20 and the working ports A and B.

Each of the nonreturn valves 25 and 26 has a moving valve head 31, 32 each of which is located inside a longitudinal channel 33, 34. Each of these channels 33, 34 has transverse supply slits 35, 36 which run transversely inside the slide 8 to open into the bore 4.

These supply slits 35, 36 are formed in such a way that, in the rest position as depicted in the figure, they are closed off by the walls of the bore 4. They are placed selectively in communication with the ports P, A or B by the movement of the slide 8.

According to one essential characteristic of the present invention, the distributor 1 further comprises two secondary nonreturn valves 40 and 41 which are respectively mounted in the longitudinal channels 33, 34 upstream of the heads 31, 32 of the main nonreturn valves 25 and 26. Thus, each of the secondary valves 40 and 41 consists of a spring 42, 43 which bears against the head 31, 32 of the main valves and acts upon a ball or valve head 44, 45.

Upstream of each of the balls, that is to say between the end of each of the channels 33, 34 and the balls 44, 45, torque slits 50, 51 run transversely inside the slide 8 to open into the bore 4. The layout of these slits is arranged such that when the slide 8 is in the rest position, the torque slits 50, 51 open into the branches 21 and 22 respectively of the supply bridge 20.

The secondary nonreturn valves 40 and 41 open during the phases of exhausting of the hydraulic fluid, into the volume opposed to the pressure of the load and remain closed when the pressure obtaining in the supply bridge 20 is below the load obtaining at A or B.

The torque slits 50 and 51 may adopt any shape suited to the particular use of the distributor in which they are installed. In particular, they are formed by transverse channels formed in the slide and which open onto the surface of this slide in the form of ports of a special shape.

In a first embodiment, the torque slits open in the form of ports of circular cross section. As an alternative, they may be of oblong cross section and in yet another alternative, they are of lens-shaped or alternatively prismatic cross section.

These torque slits 50, 51 are opened or closed according to the movement of the slide 8 and the particular application to which the distributor in which they are mounted is assigned.

As goes without saying, the invention is not restricted to the preferred embodiment described hereinabove by way of non-limiting example; on the contrary, it encompasses all the variant embodiments thereof that fall within the scope of the claims that follow.

The invention claimed is:

1. A hydraulic distributor comprising:

a distributor body (2), an intake port (P) for pressurized hydraulic fluid which port is intended to be connected to a source of pressurized hydraulic fluid, a return port (T) for returning fluid to a reservoir, at least two working ports (A, B) each of which is intended to be connected to at least one hydraulic receiver to supply and return the fluid, a slide (8) housed in a bore (4) formed in the body (2) and which is intended to be moved longitudinally to selectively transmit the pressurized hydraulic fluid to the working ports (A, B) from the intake port (P), a passage (12) formed in the body (2) for selectively connecting the intake port (P) to the working ports (A, B), regulating means (15) which are situated in said passage (12) to be inserted between the intake port (P) and the working ports (A, B) and which are associated with a load detection line channel (16), a supply bridge (20) which comprises two branches (21, 22) each opening into the bore (4) of the slide (8) on each side of the intake port (P) in order to be connected selectively to said fluid ports respectively, and two main nonreturn valves (25, 26) which are borne entirely by the slide (8), these respectively being inserted between the supply bridge (20) and the working ports (A, B) and each comprising a valve head (31, 32) able to move in a longitudinal channel (33, 34) itself connected to at least one transverse supply slit (35, 36) which opens into the bore (4), characterized in that the distributor (1) further comprises two secondary nonreturn valves (40, 41) which are respectively mounted in the longitudinal channels (33, 34) upstream of the heads (31, 32) of the main nonreturn valves (25, 26), and in that the secondary valves are connected to torque slits (50, 51) which open into the bore (4) in which the slide (8) moves, each of these slits being connected, at least in one position of the slide (8), to one branch of the supply bridge (20).

2. The hydraulic distributor as claimed in claim 1, characterized in that the secondary nonreturn valves (40, 41) are open during the phases of exhausting of the hydraulic fluid into the portion of the slide (8) opposed to the pressure of the load in the working port (A, B).

3. The hydraulic distributor as claimed in claim 2, characterized in that the torque slits (50, 51) are of circular cross section.

4. The hydraulic distributor as claimed in claim 2, characterized in that the torque slits (50, 51) are of oblong cross section.

5. The hydraulic distributor as claimed in claim 2, characterized in that the torque slits (50, 51) are of lens-shaped cross section.

* * * * *